US010959478B2

(12) United States Patent
Stolker

(10) Patent No.: US 10,959,478 B2
(45) Date of Patent: Mar. 30, 2021

(54) EYE PROTECTION ORIENTATION SYSTEM

(71) Applicant: Hummingbird Sports, LLC, Holmdel, NJ (US)

(72) Inventor: Robert H. Stolker, Holmdel, NJ (US)

(73) Assignee: Hummingbird Sports, LLC, Holmdel, NJ (US)

( * ) Notice: Subject to any disclaimer, the term of this patent is extended or adjusted under 35 U.S.C. 154(b) by 8 days.

(21) Appl. No.: 16/140,044

(22) Filed: Sep. 24, 2018

(65) Prior Publication Data

US 2019/0090577 A1 Mar. 28, 2019

Related U.S. Application Data

(60) Provisional application No. 62/562,087, filed on Sep. 22, 2017.

(51) Int. Cl.
*A42B 3/18* (2006.01)

(52) U.S. Cl.
CPC ..... *A42B 3/185* (2013.01)

(58) Field of Classification Search
CPC ..... A42B 3/185; A42B 3/20; A42B 3/324; A42B 1/247; A42B 1/08; G02C 3/02; G02C 3/003; A63B 71/10; A61F 9/027
USPC ..... 2/6.2, 6.3, 6.7, 10, 15, 209.13, 426; 351/155
See application file for complete search history.

(56) References Cited

U.S. PATENT DOCUMENTS 1,996,078 A * 4/1935 Manson ..... A42B 1/066 2/6.2
2,013,636 A * 9/1935 Shoskey ..... A42B 3/185 2/10
2,140,716 A 12/1938 Pryale
2,908,943 A 10/1959 Miller
3,818,508 A 6/1974 Lammers et al.
3,866,243 A 2/1975 Morgan
3,870,841 A 3/1975 Makowski et al.
4,477,929 A 10/1984 Mattsson
4,621,940 A 11/1986 Anderson
D287,501 S 12/1986 Davis
4,754,501 A 7/1988 Yahn
4,768,231 A * 9/1988 Schrack ..... A61F 9/045 2/13
4,808,469 A 2/1989 Hiles
4,845,786 A 7/1989 Chiarella
4,853,980 A 8/1989 Zarotti
(Continued)

FOREIGN PATENT DOCUMENTS

| | | |
|---|---|---|
| DE | 2746897 | 4/1979 |
| FR | 2294659 | 7/1976 |
| WO | 2011149895 | 12/2011 |

OTHER PUBLICATIONS http://www.gamebreaker.com/.
http://www.rehabmart.com/category/Protective_Helmets.hmt.

*Primary Examiner* — Katherine M Moran
*Assistant Examiner* — Grace Huang
(74) *Attorney, Agent, or Firm* — Vos-IP, LLC

(57) ABSTRACT

A head and facial protection system comprising a helmet and an attachable eye protection, said helmet comprising an inner and outer surface, a core between the inner and outer surfaces, a first and a second forehead mount, and a left and right post; wherein the eye protection secures to the first and second forehead mounts and the left and right posts to enable adjustment of the attachable eye protection.

4 Claims, 14 Drawing Sheets

(56) References Cited

U.S. PATENT DOCUMENTS 4,946,726 A 8/1990 Sandvig et al.
5,010,598 A 4/1991 Flynn et al.
5,056,162 A 10/1991 Tirums
5,088,130 A * 2/1992 Chiarella ..... A42B 3/066 2/411
5,129,102 A * 7/1992 Solo ..... A42B 1/247 2/10
5,150,479 A 9/1992 Oleson
5,177,815 A 1/1993 Andujar
5,272,773 A 12/1993 Kamata
5,309,576 A 5/1994 Broersma
5,339,119 A * 8/1994 Gardner ..... A61F 9/026 2/431
5,361,420 A 11/1994 Dobbs et al.
5,412,810 A 5/1995 Taniuchi
5,426,972 A 6/1995 Heirtzler et al.
5,461,727 A * 10/1995 Braswell-Moore ..... G02C 3/02 2/171
5,477,563 A 12/1995 Gentes et al.
5,517,698 A 5/1996 Nault et al.
5,598,588 A 2/1997 Lee
5,603,117 A 2/1997 Hudner, Jr. et al.
5,655,227 A 8/1997 Sundberg et al.
5,713,082 A 2/1998 Bassette et al.
5,745,923 A 5/1998 Katz
5,752,280 A * 5/1998 Hill ..... A42B 3/185 2/453
5,930,841 A 8/1999 Lampe et al.
5,950,244 A 9/1999 Fournier et al.
D424,246 S 5/2000 Ho
6,070,271 A 6/2000 Williams
6,108,825 A 8/2000 Bell et al.
6,131,209 A * 10/2000 Thayer ..... A61F 9/025 2/426
6,244,706 B1 * 6/2001 Maher ..... A42B 1/247 2/10
6,275,992 B1 * 8/2001 Bondy ..... A42B 1/247 2/10
6,330,849 B1 12/2001 Chao
6,389,607 B1 5/2002 Wood
6,453,477 B1 9/2002 Bainbridge et al.
D464,174 S 10/2002 Lu
6,481,060 B1 * 11/2002 Tsai ..... A42B 1/062 2/10
6,715,153 B2 4/2004 Mitsuhashi
6,758,562 B1 * 7/2004 Barnette ..... G02C 3/003 351/111
6,804,829 B2 * 10/2004 Crye ..... A42B 3/08 2/10
6,986,168 B2 1/2006 Abelman et al.
7,058,989 B2 6/2006 Domingos
7,152,253 B2 6/2006 Abelman et al.
7,103,923 B2 9/2006 Picotte
D535,059 S 1/2007 Lam
D577,458 S 9/2008 Chan
7,716,754 B1 * 5/2010 Ross ..... A42B 3/24 2/424
7,765,622 B2 8/2010 Wiles
7,832,023 B2 11/2010 Crisco
7,979,921 B2 * 7/2011 Cotutsca ..... A42B 1/247 2/209.13
8,191,179 B2 6/2012 Durocher et al.
8,256,032 B2 9/2012 Muskovitz
D669,225 S 10/2012 Woxing
8,296,868 B2 10/2012 Belanger et al.
D671,272 S 11/2012 Clement
D683,904 S 6/2013 Ho
D683,905 S 6/2013 Wills
8,453,269 B2 * 6/2013 Hampton, II ..... A42B 3/08 2/421
8,484,762 B2 7/2013 Goldstein
8,613,114 B1 12/2013 Olivares Velasco
8,640,267 B1 2/2014 Cohen
D700,746 S 3/2014 Capozzi
8,763,166 B1 7/2014 Olivares Velasco
8,782,821 B2 * 7/2014 Brown ..... A61F 9/02 2/439
8,832,870 B2 9/2014 Belanger et al.
8,997,265 B2 4/2015 Olivares Velasco
D745,744 S 12/2015 Saam
D752,294 S 3/2016 Chilson
D752,814 S 3/2016 Chilson
D759,899 S 6/2016 Finiel
D773,120 S 11/2016 Storey
D776,357 S 1/2017 Marting
10,492,558 B2 * 12/2019 Pfanner ..... G02C 3/02
2004/0154080 A1 8/2004 Abelman et al.
2004/0209744 A1 10/2004 Tsujimoto
2004/0250340 A1 12/2004 Dennis et al.
2005/0086727 A1 * 4/2005 Shen ..... A42B 1/08 2/411
2005/0204456 A1 9/2005 Dennis et al.
2006/0206976 A1 * 9/2006 Futch ..... A42B 3/08 2/9
2011/0225706 A1 9/2011 Pye
2012/0047636 A1 3/2012 Fehmel
2012/0047765 A1 * 3/2012 Kolesar ..... A42B 3/185 34/442
2012/0233746 A1 9/2012 Jwa
2012/0317705 A1 12/2012 Lindsay
2013/0025031 A1 1/2013 Laperriere et al.
2013/0036531 A1 2/2013 Belanger et al.
2013/0174329 A1 7/2013 Hanson et al.
2014/0096312 A1 4/2014 Vito
2019/0133236 A1 * 5/2019 Shida ..... A61F 9/02
2019/0365009 A1 * 12/2019 Frieder, III ..... A42B 3/185

* cited by examiner

EYE PROTECTION ORIENTATION SYSTEM

CROSS REFERENCE TO RELATED APPLICATIONS

This application claims the benefit of U.S. Provisional Application No. 62/562,087, filed Sep. 22, 2017.

FIELD OF INVENTION

This invention is generally related to mounting systems of a helmet, and in particular mounting systems that are able to selectively mount and adjust eye protection onto a helmet.

BACKGROUND OF THE INVENTION

Helmets have a long history of use in athletics as well as in motorsport and events where head trauma is possible. Many of these helmets have a single, fixed eye protection that is attached to the helmet to prevent eye injury. For example, in motocross, steel cages or rigid clear polycarbonate shields and visors are frequently secured to the helmet for protection. Similarly, in American football the facial cage protects the eyes with a rigid metal cage or clear polycarbonate material.

For many years no protection was used in ice hockey, but eventually helmets were included to protect from head trauma. Indeed, ice hockey is just one example of a sport adding head protection to reduce the occurrence of head trauma. However, even with the adoption of head protection, helmets vary greatly in their level of facial or eye protection, with some including full facial shields or cages while others include a smaller visor comprising a rigid metal or plastic cage or clear polycarbonate material. These cages or visors are mounted rigidly to the helmet to function as an extension of the helmet.

Another sport that adopted helmet protection over the past 30 years is the ski and snowboarding industry. Early on, skiers and riders recognized the need for head protection with the advent of terrain parks that included rails and obstacles, as falls were more prevalent and the surface unforgiving, resulting in significant injury. Finally, members of the general population recognized that helmets should be used for all terrain, as any fall included a significant risk of head injury. In ski applications, helmets frequently provide space for wear and use of preferred eyewear. Some individuals prefer to ski with traditional sunglasses, while others use sport specific goggles. Many helmets have included snaps or guides in the helmets to enable better placement of specific eyewear to ensure its proper fit for the user.

SUMMARY OF THE INVENTION

The inventions and embodiments described herein are directed toward a mounting system for eye protection to a helmet, said system comprising a helmet and an eye protection; said eye protection comprising, a top mounting component, two arms, and two temple mount components on each of the two arms of the eye protection; said top mounting component engaging to a portion of the helmet in a flexible manner to orient the eye protection in the vertical direction, and the two temple mounts comprising means in the helmet to secure to the two arms of the eye protection in a flexible but more resilient manner than said top mounting component to secure said eye protection in the horizontal and lateral directions. In certain embodiments, the temple mount utilizes a flexible string or cloth material or a stretchable/elastic material. The more resilient connection at the two arms is preferably with a plastic material, being flexible laterally but generally inflexible in a vertical manner, i.e. it can twist but does not extend.

A protection system comprising a helmet and an attachable eye protection, said helmet comprising at least one support anchor disposed of inside of the helmet adjacent to the forehead and at least one support anchor disposed of on each side of the helmet adjacent to the ear; said attachable eye protection comprising a frame having two rims, a top bar, at least one top bar mount, two arms hingeably attached to the frame, and at least one hole disposed of on each arm; at least one connection length secured between the at least one support anchor disposed of inside of the helmet adjacent the forehead and the at least one top bar mount; and at least two connection means between the at least one hole disposed of on each arm and the at least one support anchor disposed of on each side of the helmet adjacent to the ear. In certain embodiments, the protection system further comprises a second support anchor disposed of inside of the helmet adjacent to the forehead, and a second top bar mount.

In a further embodiment, the protection system as described in the embodiment above utilizes a connection means between the at least one hole disposed of on each arm, and the at least one support anchor disposed of on each side of the helmet adjacent to the ear comprises a pin attached to said support anchor, said pin engaging the at least one hole. In other embodiments, said connection means between the at least one hole disposed of on each arm and the at least one support anchor disposed of on each side of the helmet adjacent to the ear utilizes a hook-and-loop material to secure said hole to said support anchor on each side of the helmet.

Certain embodiments may further comprise a polycarbonate material disposed of in each rim.

A further embodiment is directed toward a protection system comprising a protective headgear and an attachable protective eyewear apparatus wherein said attachable protective eye wear apparatus comprises a frame, protective bars or clear protective lens, at least one top bar mount, and two arms hingeably attached to the frame; said protective eyewear apparatus is adjustably attached to said protective headgear; said protective headgear comprises least one support anchor disposed of adjacent to the forehead and at least one ear support anchor disposed of on each side of the helmet adjacent to the ear; an attachment length is secured between said top bar mount and said at least one support anchor disposed of adjacent to the forehead, said attachment length can be adjusted to raise or lower the protective eyewear apparatus; and said ear support anchor has at least two mounting positions allowing the protective eyewear position to be adjusted fore and aft in relation to said protective headgear.

A further embodiment is directed toward a protection system comprising a protective headgear, an attachable protective eyewear apparatus, at least one securing strap between said protective headgear and said attachable protective eyewear apparatus, wherein said attachable eyewear apparatus comprises a frame, protective bars or clear protective lens, at least one top bar mount, and two straps attached to the frame; said protective eyewear apparatus is adjustably attached to the protective headgear; said protective headgear comprises at least one support anchor disposed of adjacent to a forehead and at least one strap anchor disposed on each side of the helmet adjacent to the ear; said at least one securing strap secured between said top bar mount and said at least one support anchor disposed of adjacent to the forehead, said securing strap being adjustable to raise or lower the protective eyewear apparatus; and said two straps attached to the frame being adjustably secured, one on each side to the at least one strap anchor disposed of on each side of the helmet adjacent the ear, said two straps being adjustable fore and aft in relation to said protective headgear.

A further embodiment is directed toward a protection system comprising a protective headgear and an attachable protective eyewear apparatus wherein said attachable protective eyewear apparatus comprises a frame, protective bars or clear protective lens, at least one top bar mount, and two arms hingeably attached to the frame; said protective eyewear apparatus is adjustably attached to said protective headgear; said protective eyewear apparatus compromises at least one support anchor disposed of adjacent to a forehead portion of said headgear and at least one support anchor disposed of on each side of the headgear adjacent to an ear portion; a forehead adjacent anchor length engaged between said headgear support anchor and said eyewear apparatus, said forehead adjacent anchor length adjustable to raise or lower the protective eyewear apparatus; and said ear adjacent anchor comprising at least two mounting positions allowing the protective eyewear position to be adjusted fore and aft in relation to said protective headgear.

A protection system comprising a protective headgear and an attachable protective eyewear apparatus wherein said attachable protective eyewear apparatus comprises a frame, protective bars or clear protective lens, at least one top bar mount, and two straps attached to the frame; said protective eyewear apparatus is adjustably attached to the protective headgear; said protective eyewear apparatus compromises at least one support anchor disposed of adjacent to a forehead portion of said headgear and at least one support anchor strap disposed on each side of the helmet, adjacent to the ear; a forehead adjacent anchor length disposed of between said helmet and said attachable protective eyewear apparatus, said forehead adjacent anchor length being adjustable to raise or lower the protective eyewear apparatus; and said ear adjacent anchor strap length capable of being adjusted fore and aft in relation to said protective headgear.

A preferred embodiment is directed toward a head and facial protection system comprising a helmet and an attachable eye protection, said helmet comprising an inner and outer surface, a core between the inner and outer surfaces, and a front, left, right, and rear portion; said helmet comprising at least one forehead mount disposed of on an inner surface of the helmet adjacent to the front portion, and at least one support anchor disposed of on the left and right portions of the helmet; said attachable eye protection comprising a frame having two rims, a bridge, a top bar, at least one top bar mount positioned on the top bar, a left arm and a right arm hingeably attached to opposing sides of the frame, and at least one hole disposed of on each arm; at least one connection length secured between the at least one forehead mount disposed of on the inner surface of the front portion and the at least one top bar mount; and at least a second and third connection means, said second connection means defined between the at least one hole disposed of on the left arm and the at least one support anchor disposed of on the left portion of the helmet and said third connection means between the at least one hole disposed of on said right arm and the at least one support anchor disposed of on the right portion of the helmet.

In a further embodiment, the protection system further comprising a second support anchor disposed of inside of the helmet adjacent to the forehead, and a second top bar mount.

In a further embodiment, the protection system further comprising wherein said connection length is a hook-and-loop material.

In a further embodiment, the protection system further comprising wherein said connection means between the at least one hole disposed of on each arm and the at least one support anchor disposed of on each of the left and right sides of the helmet wherein the support anchor is a pin, said pin engaging the at least one hole. In a preferred embodiment, the protection system wherein the pin is disposed of on the inner surface of the helmet. In a preferred embodiment, wherein the pin is disposed of within the core of the helmet.

In a further embodiment, the protection system further comprising wherein said connection means between the at least one hole disposed of on each arm and the at least one support anchor disposed of on each of the left and right side of the helmet utilizes a hook-and-loop material to secure said hole to said support anchor on each of the left and right side of the helmet.

In a further embodiment, the protection system further comprising polycarbonate disposed of in each rim.

A further embodiment is directed toward a protection system comprising: a protective headgear, an attachable protective eyewear apparatus, and at least one securing strap between said protective headgear and said attachable protective eyewear apparatus; wherein said headgear comprises a front, rear, left, and right portion, an inner and outer surface, and a core defined between said inner and outer surfaces; and said attachable eyewear apparatus comprising a frame, protective bars or clear protective lens, at least one top bar mount connecting at the top of said frame, a left and right arm hingeably attached to the frame, and two straps attached to the top bar mount; said protective eyewear apparatus is adjustably attached to the protective headgear; said protective headgear comprises at least one support anchor disposed of adjacent to the inner surface of the front portion of the headgear and at least one strap anchor disposed of on each of the left and right sides of the headgear, said at least one securing strap secured between said top bar mount and said at least one support anchor disposed of adjacent to the inner surface of the front portion of the headgear, said securing strap being adjustable to raise or lower the protective eyewear apparatus; and said two straps attached to the left and right arms being adjustably secured, one on each side to the at least one strap anchor disposed of on each of the left and right sides of the headgear, said two straps being adjustable fore and aft in relation to said protective headgear.

In a further embodiment, the protection system further comprising wherein said left and right arms comprise at least one hole disposed of at a distal end of said arms to attach to said two straps.

In a further embodiment, the protection system further comprising wherein the left and right arms comprise a plurality of openings at the distal end aligned along the length of the arm from the distal end toward the proximal end and wherein the adjustable nature fore and aft in relation to said protective headgear is modified by election of one of the plurality of openings.

In a further embodiment, the protection system further comprising wherein the at least one securing strap provides securement of the attachable protective eyewear apparatus in at least a first direction and wherein the two straps provide securement of the attachable protective eyewear apparatus in at least a second direction. In a further embodiment, wherein the attachable protective eye wear apparatus enables movement and orientation of the protective eyewear apparatus in the x, y, and z planes in relation to the protective headgear by modifying the lengths of the at least one securing strap or of the two straps.

In a further embodiment, the protection system further comprising wherein the at least one securing strap is more flexible than the arms of the attachable protective eyewear apparatus.

A further embodiment is directed toward a facial and head protection system comprising a protective headgear and an attachable eyewear apparatus; said protective headgear comprising an inner and outer surface; and a compressible core disposed of between the inner and outer surfaces; said headgear having a rear portion, a front facing portion, and a left and right side portion, said headgear configured for covering a portion of a user's head; said front facing portion comprising at least one forehead mount providing a mount accessible on the inner surface of the front facing portion; and comprising a latch component accessible on the inner surface of the left and right side portions of the headgear; said eyewear apparatus comprising a frame comprising a top bar, a right rim, a left rim, and a bridge connecting the same, a hinge point connected to the frame and positioned at the outer edge of each of the right rim and left rim, and an arm attached to each hinge point, said arm comprising at least one opening; said top bar comprising at least one top bar mount; wherein said top bar mount and said forehead mount are configured to secure therebetween a connection means; and wherein said latch component and said at least one opening on the left and right arms are configured to secure therebetween a connection means.

In a further embodiment, the protection system further comprising wherein the forehead mount is embedded within the compressible core.

In a further embodiment, the protection system further comprising wherein the latch component is a pin, and wherein said connection means between the at least one opening disposed of on each arm and the at least one pin disposed of on the left and right sides of the helmet comprises said pin engaging with the at least one hole. In a further embodiment, wherein the arms of the eyewear apparatus are more rigid than the connection means securing said top bar mount and said forehead mount.

In a further embodiment, the protection system further comprising wherein the attachable eyewear apparatus can be adjusted in the x, y, and z coordinates to optimize fit of the eyewear apparatus. In a further embodiment, the protection system further comprising wherein the connection means is selected from the group consisting of a strap, hook-and-loop material, a string, or combinations thereof. In a further embodiment, wherein the attachable eyewear apparatus can be oriented at different angles based upon the connection and positioning of the arms or the arms and/or the forehead mount to the headgear.

DETAILED DESCRIPTION OF THE PREFERRED EMBODIMENTS

The system detailed herein provides for an adjustable mounting system for eye protection. In particular, this system allows for individualized and customizable fit for each user for the particular helmet and eye protection to be utilized. Indeed, this allows for customization of eye protection based upon the particular size and shape of the individual, as well as personal preferences regarding look and feel.

For example, individualized protection may allow for one user to have a metal only cage that provides eye protection. A second user may choose a cage that further includes embedded polycarbonate lenses for additional protection or tinted polycarbonate for sunny situations. Others may choose a wholly plastic or clear polycarbonate fit. Finally, others may eliminate the eye protection or choose to use eye protection that does not engage to the helmet itself. The ability for varied fit and structural options provides a unique modular headgear solution.

Figure 1:
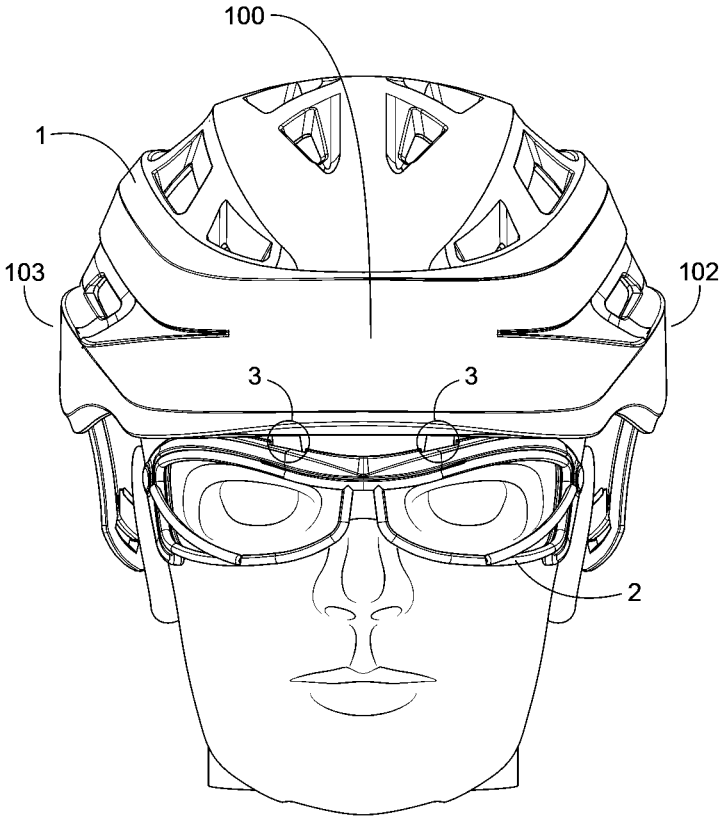
FIG. 1 depicts a front image of a helmet with attached eye protection.

FIG. 1 provides a first embodiment of an eye protection system or device that comprises a helmet or headgear portion (helmet or headgear being used interchangeably throughout) 1, the helmet 1 having a front portion 100, a rear portion 101, a left portion 102, and a right portion 103, and an eye protection component 2 and attachment means 3 between the helmet 1 and the eye protection component 2. As shown in greater detail in FIGS. 6 and 7, the attachment means 3 are secured to the helmet 1 at helmet forehead mounts 20, which are positioned in or on the helmet 1. The attachment means then secure to the glasses top bar mounts 13.

A preferable material for the attachment means 3 is a hook-and-loop material strap, one that utilizes a flexible but resilient material that does not stretch more than 25% of its length, and preferably does not stretch more than 10% of its length, and more preferably does not stretch more than 5% or 1% of its length. Use of a hook-and-loop material for the attachment means 3, provides that a hook-and-loop strap can extend around the glasses top bar mount 13, which provides a rigid bar within said glasses top bar mount 13 to secure such a strap around said rigid bar and then wrap around a further bar in the helmet forehead mount 20. Through shortening or lengthening of the hook-and-loop material, the eye protection can be oriented on the helmet in a desired vertical position. Furthermore, as the hook-and-loop material is flexible, it will hang and have some movement within all axes (but limited in the vertical direction) without significantly distorting the position of the eye protection 2 if an impact hits the eye protection.

In many situations in the prior art, when eye protection is worn without an attachment to a helmet 1, the eye protection goggles are positioned directly on the face of a user. When the goggles are disturbed on the face of the individual, she must stop and adjust the eye protection goggles to ensure proper fit and function. Often eye goggles are in contact with several places on the face, and this disturbance moves them out of place and requires movement with hands to get back to a normal resting place that is comfortable. The embodiments herein eliminate this problem. With the flexible but secure attachment as described herein, movement may occur, but the eye protection 2 will simply move back to its normal resting state upon a disturbance force being applied to the goggles of the present embodiments, i.e. the goggles being hit by a ball, stick, or player.

The helmet forehead mounts 20 can also directly attach the straps to the helmet 1. For example, instead of a bar allowing a single strap to wrap around the bar, two ends of a strap may just be secured directly to the helmet 1. For example, the strap may be embedded into the helmet or have a snap or other component to securely attach the strap to the helmet itself.

Figure 2:
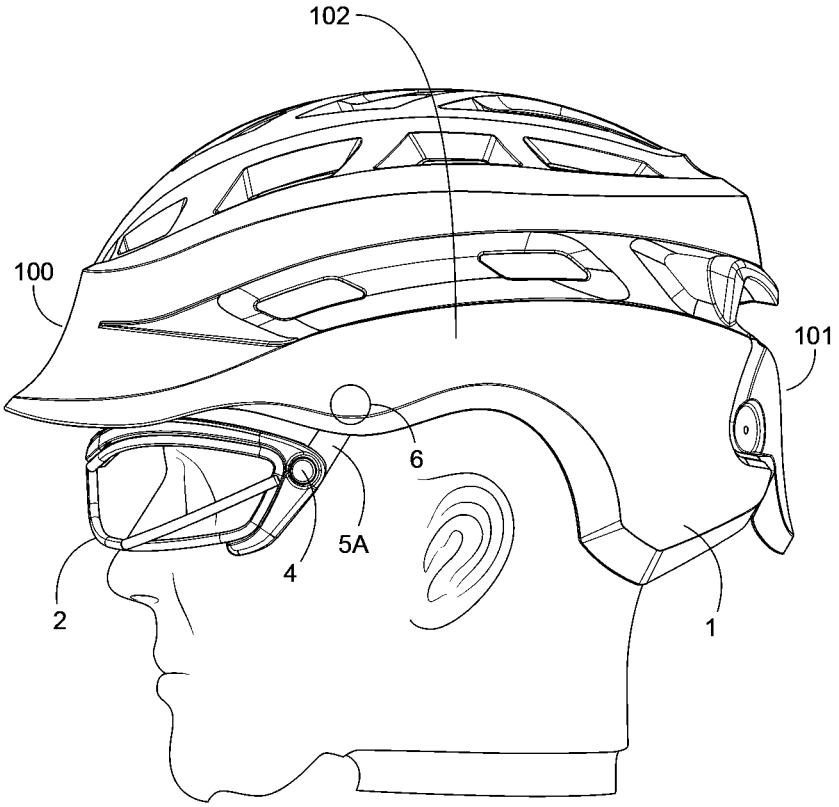
FIG. 2 depicts a side image of the helmet with attached eye protection.

FIG. 2 provides a side profile of the system, with the goggles shown away from the forehead of the individual in resting state. The arms (also called "temples") 5A are attached to the eye protection 2 at the hinge 4. Use of a hinge 4 allows the arms 5A to move to allow for various fits to meet the contours of the facial structure of each individual user. These arms 5A are then attached to several points on the helmet 1. Two contact points for the arms 5A are adjacent to or above the ear of the helmet. In this manner, the eye protection 2 is held on each side of the helmet with a structure and is adjustable to the fit of each individual user.

For appropriate connection of the arms 5A to the helmet 1, several different securing mechanisms may be utilized. For example, in FIG. 2, a latch 6 is provided to allow for a strap or other securing device to connect to the eye protection and secure tightly to the latch 6. This latch may be on the interior or exterior of the helmet 1, or even embedded within the foam material or core of the helmet.

However, even once connected to the helmet, by allowing the arms 5A to move at the hinge 4, the individual user can adjust the horizontal and lateral fit of the eye protection 2 for the user. Indeed, pulling the arms 5A tighter to the face of the user would pull the eye protection 2 in the lateral direction and to some extent slightly in the horizontal direction. Use of the connection means provides for variation in fit, which will allow the head protection system, including the helmet 1 and eye protection 2, to provide for variable fit for different users.

Figure 3:
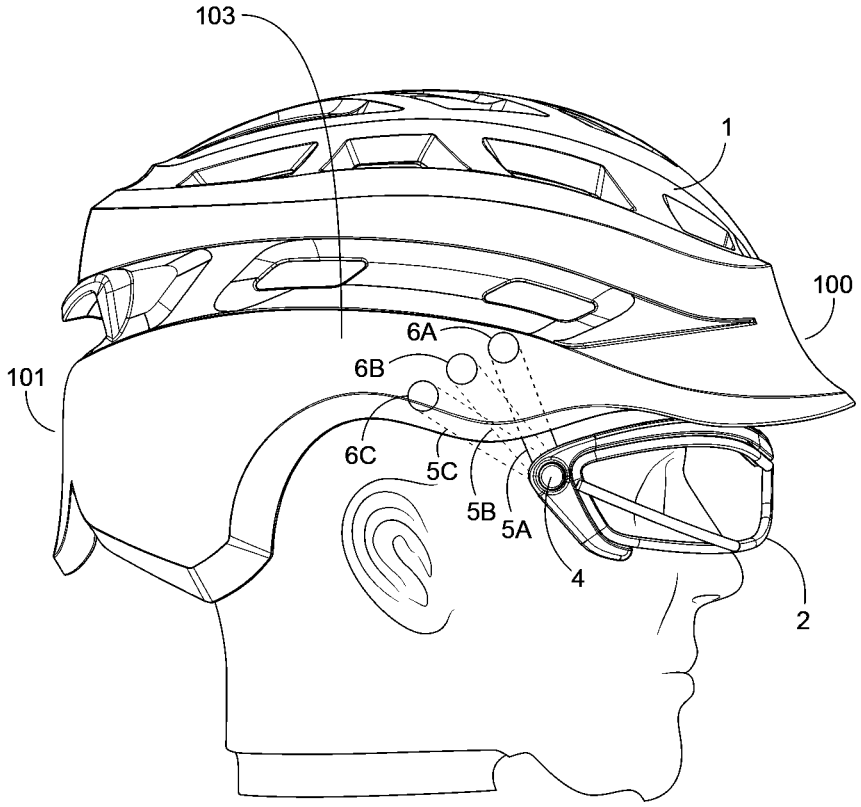
FIG. 3 depicts the opposing side of the helmet with attached eye protection.

For example, FIG. 3 details different arm positions 5A, 5B, and 5C that could be used to secure the arm to the helmet. These different positions will allow for slightly different fit and feel for the user. Accordingly, the position of the latch 6 must be sufficiently aft of the temple to ensure that such adjustments can be made. However, to secure each of these different positions, the latch 6 must have different securing points within the helmet to enable the different positions of 5A, 5B, and 5C. These different latch positions are identified as 6A, 6B, and 6C. The various embodiments herein describe different latch and securing mechanisms that can be utilized to allow for these various orientations, for example, by providing different positions and different angles of the arm 5A, i.e. the angle of the arm 5A is different than when the arm is in position 5B or 5C, these points simply being alternative positions of the arm. Thus, the angle or the tilt of the eye protection themselves can be modified through use of different arm positions. Thus, different face sizes, structures, and curves can independently optimize fit and feel of the eye protection and ultimately provide a highly customizable head and face protection system through these variations in the design.

Figure 7:
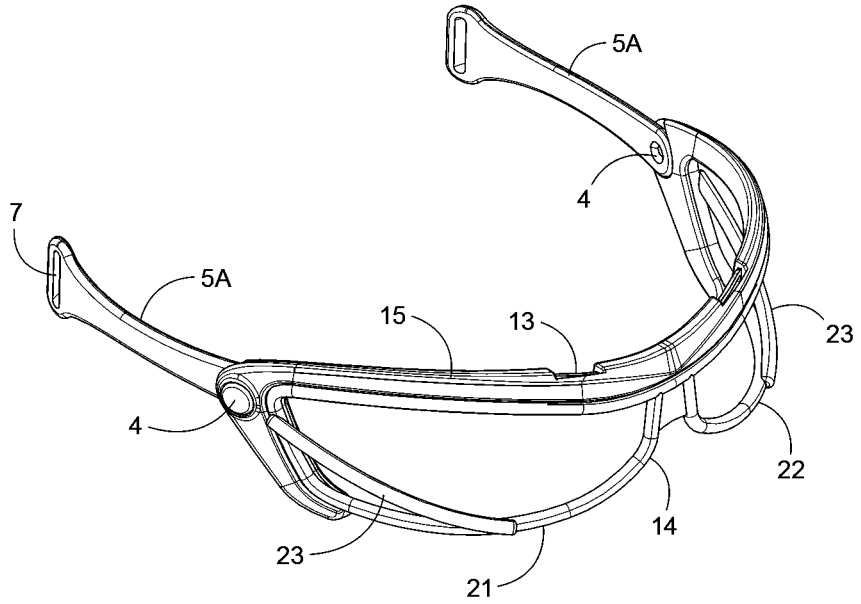
FIG. 7 depicts a side view of the eye protection.

Indeed, one possible embodiment for securing the arm to the helmet is envisioned, for example, in FIG. 7, wherein the rear arm opening 7 would accept a strap and said strap would be tightened appropriately to the hinge 6 to secure the eye protection in place.

Figure 4:
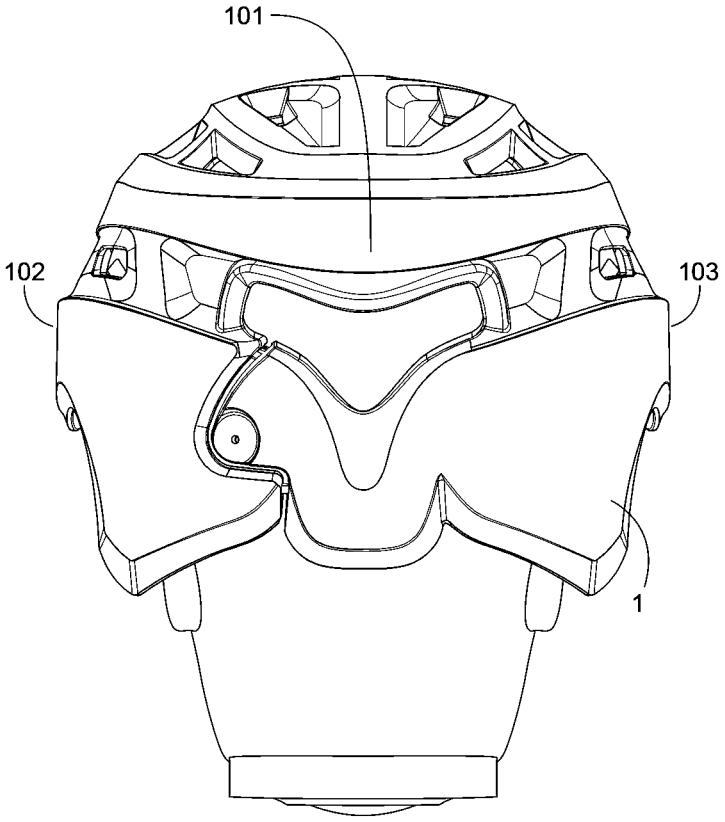
FIG. 4 depicts a rear view of the helmet.
Figure 5:
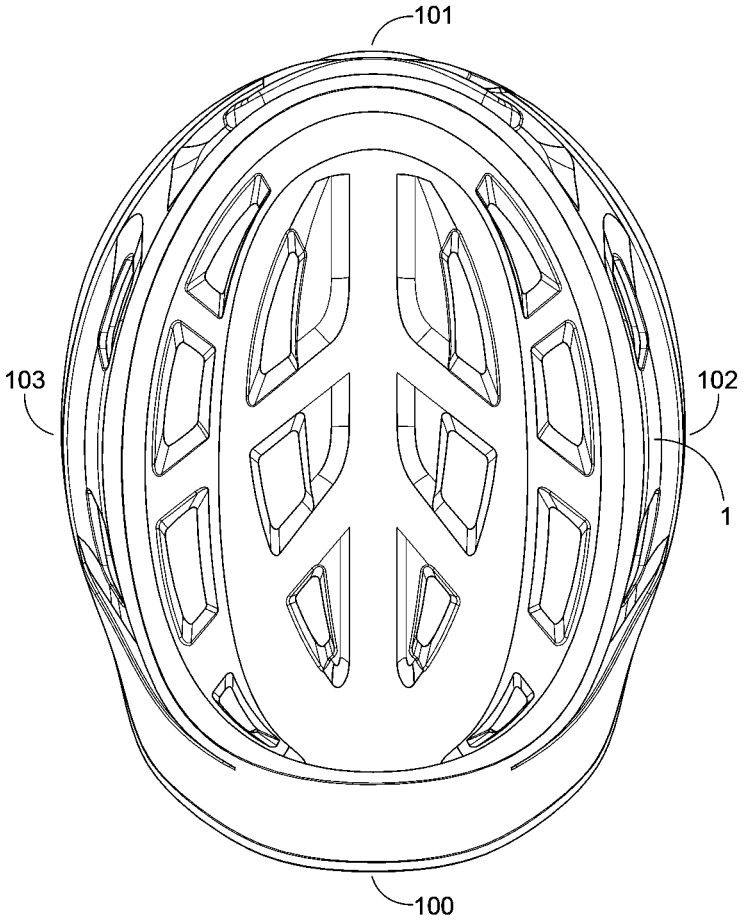
FIG. 5 depicts a top view of the helmet.

FIGS. 4 and 5 give additional views of the helmet. For example, FIG. 4 simply details the helmet from the rear position and FIG. 5 details the helmet from a top plan view. The various vents in the helmet enable air flow, but also reduce the weight of the helmet.

Figure 6:
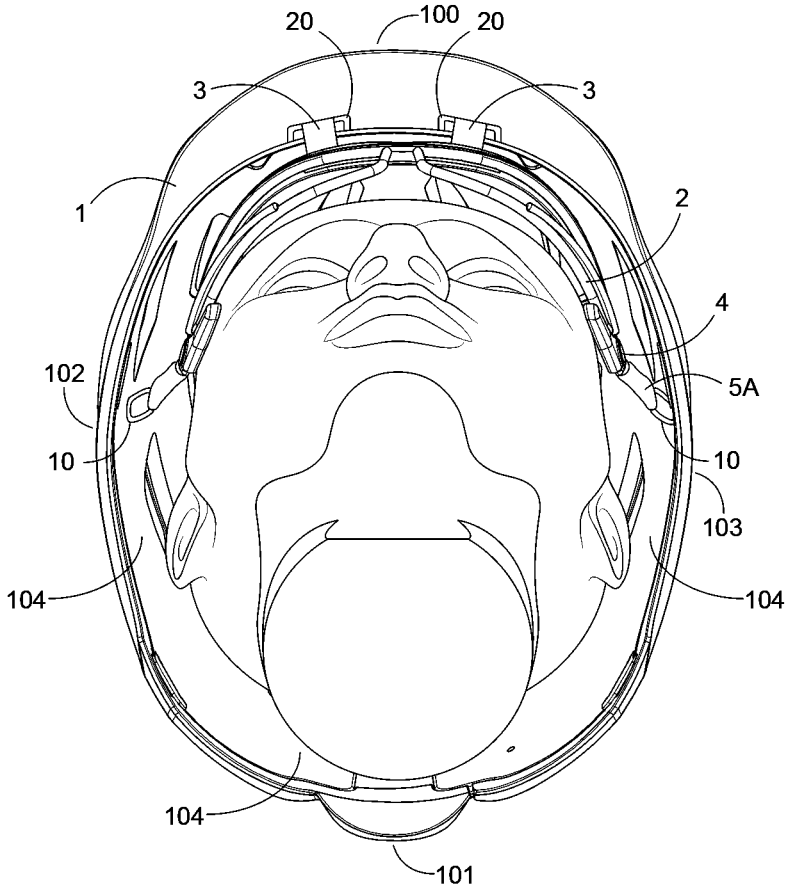
FIG. 6 depicts a bottom view of the helmet with embedded eye protection.

FIG. 6 gives a bottom view of the protection system, particularly depicting the location of the forehead mounts 20 within the helmet, mounted to the inner surface 104 of the front portion 100. These forehead mounts 20 are anchoring components that allow for securing of a strap 3 between the forehead mounts 20 and the top bar mounts 13. The forehead mounts 20 allow for the frontal securement of the eye protection component. Rear mounts are then included, e.g. the latch 6, to allow for securing of the arms of the eye protection via any one of the several means as described herein, including with straps, buckles, post and opening, etc. Combined, the forehead mounts 20 and the latch 6 feature, enable a secure connection of the eye protection to the headgear and provide for a highly customizable fit.

Indeed, as described above, FIG. 5 further identifies a second attachment embodiment for the arms 5A. However, FIG. 6 depicts the use of a temple post 10. The temple post 10 is provided within the helmet to allow for anchoring of the eye protection 2 to the helmet 1 by securing into the post 10 one opening 8 on the arm. For example, FIG. 10A details five different openings 8. In this manner, the post 10 and openings 8 work like a belt, with the pin of the buckle being equivalent to the post 10 and the holes in the belt equivalent to the openings 8. Fitting the post 10 into the opening 8 secures the arm of the eye protection at a specific length. By having different openings 8, and individual can specifically tailor the fit, just as one would with a belt or a watch, each having the pin and buckle.

FIG. 7 details eye protection 2, with a forehead top bar 15, the top bar mount 13, and a bridge 14. The eye protection 2 further comprises a right rim 21, a left rim 22, and a rim support 23 on each of the left and right side. The eye protection 2 left and right sides are mirror images of one another. These features provide for a physical barrier between an object and the eye area, with the goal to prevent direct contact, i.e. of a ball or stick to the eye area of the user. The rear arm opening 7 is provided on each arm 5A, which accepts a strap, or a post 10 within said opening to secure the eye protection in place. However, the hinge 4 allows for the arms 5A to be oriented to find the most comfortable fit for each individual.

Figure 8:
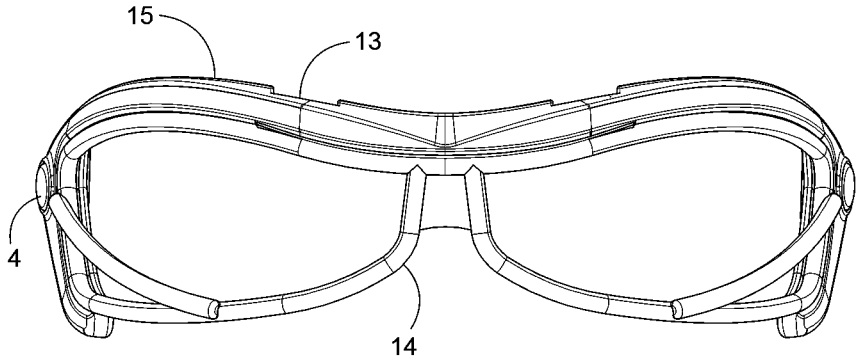
FIG. 8 depicts a front view of the eye protection.

FIG. 8 provides a further view of similar eye protection features, e.g. the hinge 4 is depicted as well as the bridge 14. Additional features previously disclosed can be seen from this front view and depict the minor image nature of the left and right sides of the eye protection 2 component.

Figure 9:
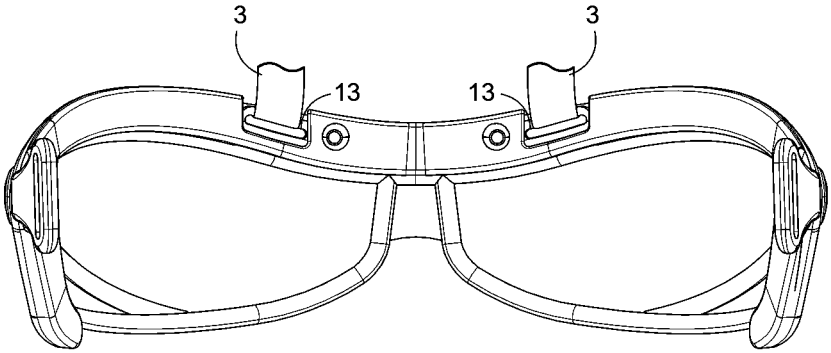
FIG. 9 depicts a rear view of the eye protection.

FIG. 9 provides a rear view of the eye protection 2 component and details several features that allow for the secure attachment to the helmet system. FIG. 9 details two straps 3 secured through the glasses top bar mounts 13 to show greater detail as to how these components would fit together. Of course, these straps 3 provide for one of the key components to secure the eye protection 2 to the helmet 1. By having both support and attachment at the top bar mounts 13 as well as at the rear of the arms 5A, at least four points connect the eye protection 2 to the headgear. This allows the eye protection 2 to be suitably secured to the helmet to provide for protection to the eye area. Because of the adjustability of the straps 3, as well as attachment means for the arms 5A, custom fit is provided. Yet, at the same time, the multiple points prevent the eye protection 2 from moving too far, being dislodged, or being too rigid and thus cause discomfort.

The eye protection is intended to sit away from the face of the user. Accordingly, no nose pad or pad arms are necessary within the bridge 14 of the eye protection 2. Accordingly, by adjustment of each of the attachment points, the eye protection 2 will sit away from the face, but through the combination of the rigidity of the arms 5A and the tension at the top bar mount 13 to the forehead mount 20, the eye protection 2 will resist movement to a sufficient degree, thereby preventing contact of the ball or stick to the eye area of the user.

Figure 10A:
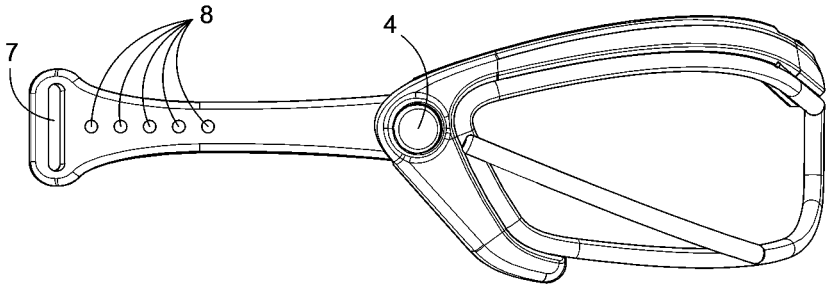
FIGS. 10A-C depict a side view of the eye protection and mounting features with a helmet, with FIG. 10A providing a right side view, FIG. 10B depicting a view showing attachment using a post and nut, and FIG. 10C depicting attachment with a post and a pocket within the core of the headgear.
Figure 10B:
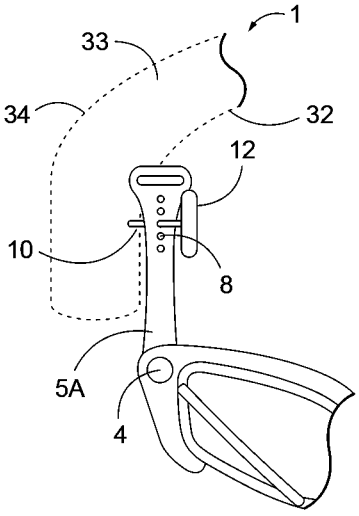
Figure 10C:
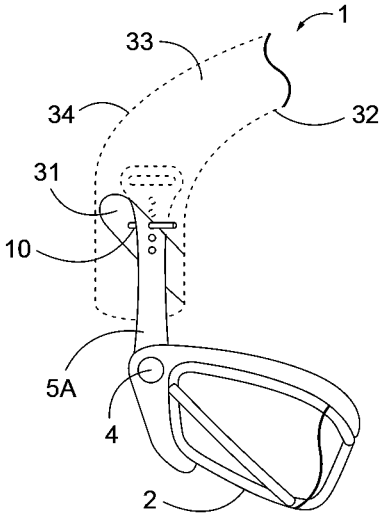

FIGS. 10A, 10B, and 10C detail use of the openings 8 with several attachment mechanisms. A helmet or headgear 1 is depicted with an inner surface 32, a core 33, and an outer surface 34. For example FIG. 10B details wherein a post 10 is mounted inside on the inner surface 32 of the helmet 1, and a post nut 12 secures into the post 10 to secure the arm 5A into place. Using this post 10 and opening 8 strategy, the arms are made of a more resilient material than the attachment means for the forehead mounting, e.g. a PVC plastic, nylon, or other material that allows for flex and rotation, but not stretching of the material. Other materials include zyl, Monel, Flexon, and also may include certain metal or metal alloys, or combinations of plastic, polymer, and/or metal materials to generate an appropriate structure and flex. In preferred embodiments, the arms are a plastic material. However, the hinge 4 still allows for some movement, as well as the arms 5A not being rigid, providing necessary give and movement to the system while retaining positioning of the eye protection, even when a force is applied to the eye protection itself.

FIG. 10C details wherein the helmet 1 actually has an opening 31 in the body of the helmet 1, and the post 10 is embedded within this opening 31, which compresses against the post. The opening 31 is a hole or pocket within the core 33 of the helmet 1. The opening 31 allows for the core 33 itself to compress against the post 10 and thus may optionally eliminate the use of a nut 12, though an optional nut can be included. The user would simply place the proper opening 8 onto the post 10 and the eye protection would be secured at the proper fit, as the core 33 would compress against the post 10. A different fit could be achieved by simply moving the post 10 to a different opening 8 on the arm. Accordingly, such feature allows for different internal features to the headgear itself. FIG. 10B provides wherein a post 10 is open to the interior face of the headgear, while FIG. 10C provides wherein the post 10 is defined within an opening 31 or cavity, which provides access to the internally positioned post 10.

Figure 11A:
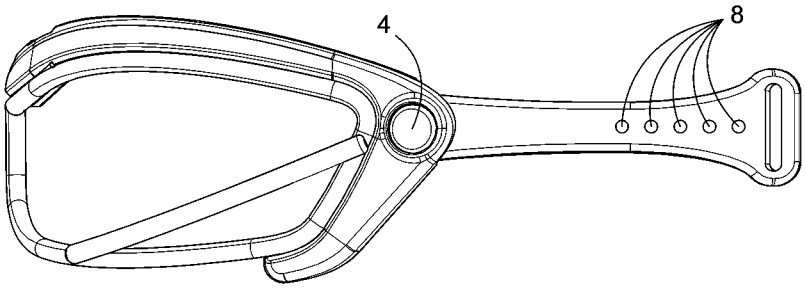
FIGS. 11A and 11B depict a side view of the eye protection with an embodiment of mounting system, with FIG. 11A depicting a right side view of the eye protection and FIG. 11B depicting an attachment of the eye protection to a latch.
Figure 11B:
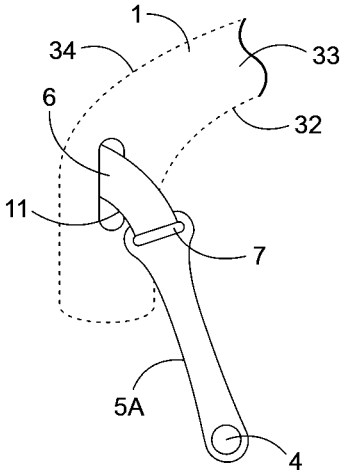

FIGS. 11A and 11B show a side profile with the hinge 4 in FIG. 11A, with five different openings 8 positioned along the arm, and a single rear opening 7 at the end of the arm 5A.

FIG. 11B depicts an embodiment using a length of strap material 11, which would connect to a latch 6 on, in, or inside the helmet 1 to secure to the rear arm opening 7 to properly tighten the eye protection to the helmet. Inherently, the use of a strap material 11 will provide more flex and give to the attachment of the arms as compared to use of a post 10 connection strategy through the openings 8. Accordingly, depending on the particular strategy, the length of the arms 5A will need to be optimized to fit as determined by an ordinary artisan, and to then provide sufficient variability (i.e. five different openings 8), or a sufficient arm length to allow for the use of a strap material 11 to connect to both the rear opening 7 and also to the latch 6 on the headgear itself.

Figure 12A:
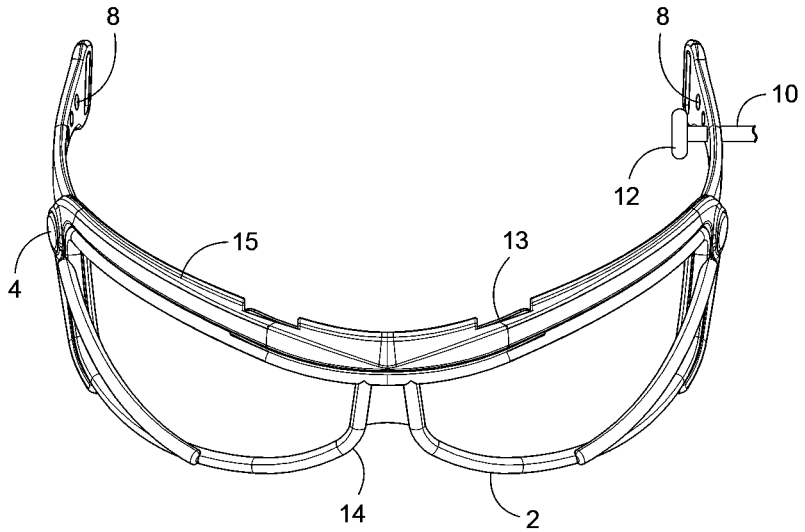
FIGS. 12A and 12B depict a further embodiment of the attachment means, with FIG. 12A depicting a top perspective view of eyeglasses and FIG. 12B depicting a side view of a portion of an attachment means.
Figure 12B:
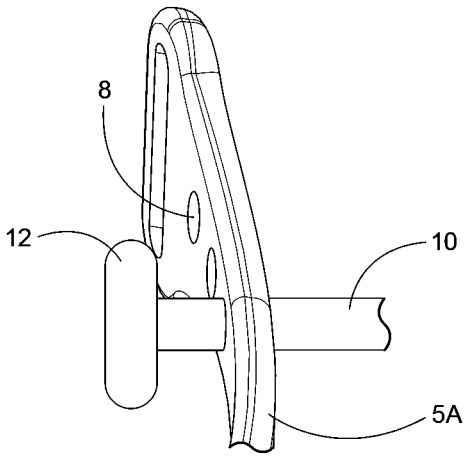

FIG. 12A details use of a post 10 and nut 12 positioned within an opening 8 of the arms. A larger detail of the same is provided in FIG. 12B.

Figure 13:
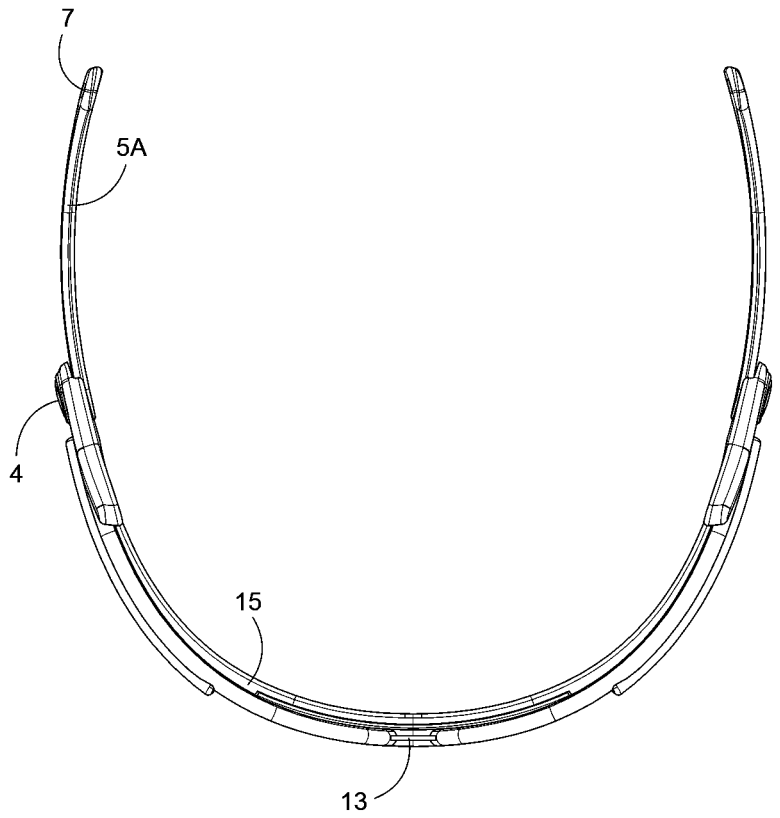
FIG. 13 depicts a top plan view of eye protection.

FIG. 13 details a top plan view of the eye protection.

Figure 14A:
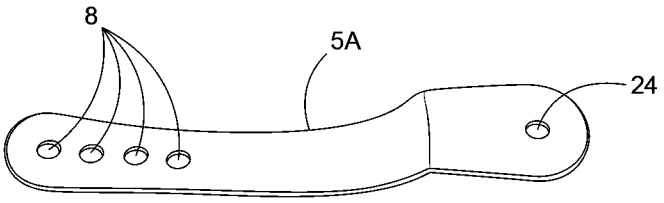
FIGS. 14A and 14B depict a further embodiment of the attachment means, with FIG. 14A depicting a bottom view of an eye protection arm and FIG. 14B depicting a top view of an eye protection arm.
Figure 14B:
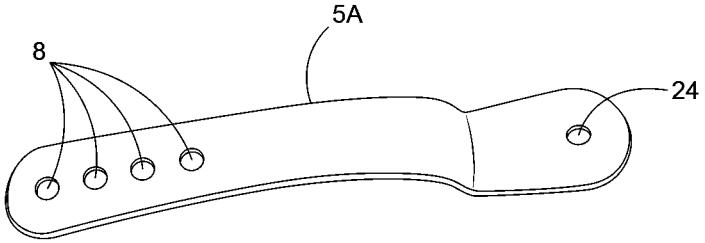

FIGS. 14A and 14B provide a front and back view of a variation of an attachment arm 5A. The arm 5A is similar to the ones depicted in, for example, FIG. 11A, having a set of openings 8. The arm 5A is attached to the hinge through the hinge opening 24. A pin or other attachment means would connect the hinge opening 24 to the body of the eye protection component.

The system provides for an unlimited amount of adjustment to properly fit eye protection to a helmet. Furthermore, as an impact occurs to the helmet or to the eye protection, the flexible but rigid fit will deflect the forces, but importantly it prevents the direct contact with the eye. Indeed, preventing the physical contact and damage to the eye is the primary goal of the eye protection.

Ultimately, no other system provides for customizable fit that allows for orientation in the horizontal, lateral, and vertical directions while ensuring a secure and adjustable fit to allow for customization for any user.

What is claimed is:

1. A head and facial protection system comprising a helmet and an attachable eye protection, said helmet comprising an inner and outer surface, a core between the inner and outer surfaces, a front, left, right, and rear portion; said helmet comprising a first and a second forehead mount, each of the first and second forehead mounts disposed of on the inner surface of the helmet adjacent to the front portion, and a left post disposed on the left portion of the helmet and a right post disposed on the right portions of the helmet; said attachable eye protection comprising a frame having two rims, a bridge, a top bar, a first and a second top bar mount positioned on the top bar, a left arm and a right arm hingeably attached to opposing sides of the frame, and at least one opening disposed of on each arm; a connection means comprising a first connection length secured between the first forehead mount and the first top bar mount, and a connection means comprising a second connection length between said second forehead mount and said second top bar mount; wherein said left post engages with the at least one opening disposed of on the left arm and wherein said right post engages with the at least one opening disposed of on said right arm.

2. The protection system of claim 1, wherein said first connection length and said second connection length are a hook and loop material.

3. The protection system of claim 1, wherein the the left post and the right post are disposed of on the inner surface of the helmet.

4. The protection system of claim 1, wherein the the left post and the right post are disposed of within the core of the helmet.

* * * * *